US006139296A

United States Patent [19]

Okajima et al.

[11] Patent Number: 6,139,296

[45] Date of Patent: Oct. 31, 2000

[54] METHOD FOR TREATING METAL SURFACE, ROTARY SHAFT FOR REFRIGERANT COMPRESSOR TREATED BY THE METHOD, VANE FOR REFRIGERANT COMPRESSOR TREATED BY THE METHOD, AND REFRIGERANT COMPRESSOR USING THE SAME

[75] Inventors: Masazo Okajima, Tochigi-ken; Ayumi Mori, Gunma-ken; Kazuhisa Ishikawa, Gunma-ken; Takeo Komatsubara, Gunma-ken; Masahiko Kamata, Tokyo; Sachimine Suga; Hiroyuki Suma, both of Kanagawa-ken; Kyoji Itou, Aichi-ken, all of Japan

[73] Assignee: Sanyo Electric Co., Ltd., Osaka-fu, Japan

[21] Appl. No.: 08/948,002

[22] Filed: Oct. 9, 1997

[30] Foreign Application Priority Data

| | | | |
|---|---|---|---|
| Oct. 11, 1996 | [JP] | Japan | 8-270032 |
| Oct. 11, 1996 | [JP] | Japan | 8-270035 |
| Oct. 11, 1996 | [JP] | Japan | 8-270036 |

[51] Int. Cl.[7] ..... F04C 18/356; C23C 8/36

[52] U.S. Cl. ..... 418/63; 418/178; 148/222

[58] Field of Search ..... 418/1, 63, 178; 148/222, 318

[56] References Cited

U.S. PATENT DOCUMENTS

| | | | |
|---|---|---|---|
| 5,090,882 | 2/1992 | Serizawa et al. | 418/178 |
| 5,187,017 | 2/1993 | Hatano et al. | 148/318 |
| 5,273,410 | 12/1993 | Kitaichi et al. | 418/178 |

FOREIGN PATENT DOCUMENTS

| | | | |
|---|---|---|---|
| 450847 | 10/1991 | European Pat. Off. . | |
| 55-038967 | 3/1980 | Japan . | |
| 56-090972 | 7/1981 | Japan . | |
| 57-098668 | 6/1982 | Japan . | |
| 59-093870 | 5/1984 | Japan . | |
| 62-075083 | 4/1987 | Japan . | |
| 62-75083 | 4/1987 | Japan | 148/318 |
| 63-173881 | 7/1988 | Japan | 418/178 |
| 5-340369 | 12/1993 | Japan . | |
| 07301188 | 11/1995 | Japan . | |

OTHER PUBLICATIONS

Chemical Abstracts, vol. 101, No. 22, Nov. 26, 1984, Columbus, Ohio, abstract No. 196019, Weng, Longshang et al. "Ion sulfonitriding of high–speed steel tools".

Chemical Abstracts, vol. 101, No. 4, Jul. 23, 1984, Columbus, Ohio, abstract No. 26815, Gawlik, Jozef et al. "Technical and economic aspects of the use of high–speed steel tools after supplemental surface treatment".

*Primary Examiner*—John J. Vrablik

*Attorney, Agent, or Firm*—Weingarten, Schurgin, Gagnebin & Hayes LLP

[57] ABSTRACT

The present invention is to provide a refrigerant compressor comprising a compressing element driven by a rotary shaft, for compressing and discharging a sucked HFC type refrigerant or refrigerant mainly comprising the HFC type refrigerant by the compressing element, where a rotary shaft applied with the plasma sulphonitriding treatment on the surface is used as the rotary shaft. Or a vane applied with the plasma sulphonitriding treatment on the surface of a vane made of a steel equivalent to a high speed tool steel vane or a steel equivalent to a stainless steel is used. Accordingly, a refrigerant compressor comprising a rotary shaft or a vane having a low friction coefficient in a sliding portion on the surface of the rotary shaft or the vane and a high wear resistance can be provided even in the case an ester type refrigerator oil or an ether type refrigerator oil is used as the refrigerator oil and an HFC type refrigerant is used.

8 Claims, 3 Drawing Sheets

METHOD FOR TREATING METAL SURFACE, ROTARY SHAFT FOR REFRIGERANT COMPRESSOR TREATED BY THE METHOD, VANE FOR REFRIGERANT COMPRESSOR TREATED BY THE METHOD, AND REFRIGERANT COMPRESSOR USING THE SAME

BACKGROUND OF THE INVENTION

1. Field of the Invention

The present invention relates to a method for treating a metal surface and a member treated by the method, and a refrigerant compressor using the member, and more specifically, relates to a refrigerant compressor used in a freezer where an HFC refrigerant, which does not have the risk of destroying the ozone layer, is used with an improved wear resistance of the sliding surface of a rotary shaft or a vane.

2. Background Art

As a conventional refrigerant for a freezer, R-502, which is an azeotropic mixed refrigerant including dichlorodifluoromethane (R-12) or R-22, and monochloropentafluoroethane (R-115a) is used, and such a refrigerant is preferable for an ordinary freezer. Further, a refrigerating cycle where a refrigerator oil, compatible with such a refrigerant, including a mineral oil or an alkyl benzene type oil attains a high quality in terms of reliability and durability.

However, since the above-mentioned refrigerant is highly destructive with respect to the ozone layer and thus it will destroy the ozone layer if it is discharged in the atmosphere and reach the ozone layer in the sky. The destruction of the ozone layer is caused by chlorine atoms (Cl) in a refrigerant.

Therefore, refrigerants containing little amount of chlorine such as chlorodifluoromethane (HCFC-22, R-22), and refrigerants not containing chlorine such as difluoromethane (HFC-32, R-32), pentafluoroethane (HFC-125, R-125) and 1,1,1,2-tetrafluoroethane (HFC-134a, R-134a) are considered as substitute refrigerants (hereinafter referred to as HFC type refrigerant).

Examples of refrigerator oils used for the HFC type refrigerants include those which are incompatible with the HFC type refrigerants such as a mineral oil and an alkyl benzene type oil, those which are compatible with the HFC type refrigerants such as an ester type refrigerator oil and an ether type refrigerator oil, and a mixture oil thereof.

Conventionally, the surface of a rotary shaft of a compressor such as a rotary type compressor and a reciprocating type compressor has been applied with surface treatment in order to improve the wear resistance of the sliding surface, such as the salt bath soft nitriding treatment, the ion nitriding treatment, the salt bath sulphonitriding treatment, and the electrolytic sulphonitriding treatment. However, with the refrigerant replaced by the HFC type refrigerant, and the refrigerator oil replaced by the ester type refrigerator oil or the ether type refrigerator oil, compound layers applied with the conventional treatment (mainly comprising a nitride ($\epsilon$-$Fe_3N$)) are not sufficient in terms of wear resistance due to a high friction coefficient, and thus it is impossible to operate stably in over a long time. Therefore, an improved treatment method of a rotary shaft, a compressor comprising the treated rotary shaft, such as a rotary type compressor and a reciprocating type compressor are strongly called for.

Further, with the refrigerant replaced by the HFC type refrigerant and the refrigerator oil replaced by the ester type refrigerator oil or the ether type refrigerator oil, the material of the rotary shaft needs to be a highly elastic ductile cast iron (FCD). However, by the use of a highly elastic material, particularly the FCD, since the center hole of the rotary shaft, that is, the hole for circulating the refrigerator oil from the oil pool at the lower part of the refrigerant compressor to the upper part of the refrigerant compressor has been formed conventionally by machining, the machine work becomes difficult. Therefore, a refrigerant compressor comprising a highly elastic rotary shaft where the center hole can be formed economically and easily is strongly called for.

On the other hand, a vane for a rotary type compressor is made from SKH 51 with the surface treatment for improving the wear resistance such as the ion nitriding treatment and the CrN coating treatment, or is made from an aluminum impregnation carbon material or a fiber reinforced aluminum material.

However, with the refrigerant replaced by the HFC type refrigerant and the refrigerator oil replaced by the ester type refrigerator oil or the ether type refrigerator oil, since the friction coefficient is high in the case of the conventional surface treatment such as the ion nitriding treatment, the ester type refrigerator oil or the ether type refrigerator oil is hydrolyzed by the moisture existing in the refrigerating circuit due to a high temperature caused by the friction so as to generate an acid. In this case, a sludge such as a metallic soap is formed due to the generated acid, and thus problems occur such as accumulation of the sludge on the sliding portion of the surface of a vane, corrosion and wearing. Further, in the case of the CrN coating treatment, it involves problems such as peel-off of the coating during the operation and difficulty of production by irregularity of the coated film thickness. In the case of a vane made from an aluminum impregnation carbon material or a fiber reinforced aluminum material, since it is insufficient in terms of the mechanical strength and the wear resistance, and aggressive with respect to the counterpart roller, it is impossible to operate a rotary compressor comprising such a vane stably over a long time.

An object of the present invention is to provide a refrigerant compressor comprising a rotary shaft or a vane having a low friction coefficient of the rotary shaft or a sliding portion on the surface of the vane, and a high wear resistance even if an ester type refrigerator oil or an ether type refrigerator oil is used as the refrigerator oil, and an HFC type refrigerant is used, to provide a refrigerant compressor comprising a highly elastic rotary shaft where the center hole can be formed economically and easily, and to provide a refrigerant compressor capable of preventing the generation of a sludge on the sliding portion of the surface of a vane and operating stably over a long time. A further object of the present invention is to provide a treating method used therein.

SUMMARY OF THE INVENTION

In order to solve the above-mentioned problems, the present inventors have studied to find out that the above-mentioned problems can be solved by the use of a vane made from a steel equivalent to a high speed tool steel or a vane made from a steel equivalent to a stainless steel applied with the plasma sulphonitriding treatment on the surface to lead to the present invention. Furthermore, they learned that the above-mentioned problems can be solved by applying the plasma sulphonitriding treatment on the surface of the rotary shaft so as to have a low friction coefficient and an improved wear resistance, and by forming the center hole using the sublimation pattern model or the shell core in the casting stage of the rotary shaft to lead to the present invention.

The present invention according to the above-mentioned object is to provide a method for treating a metal surface where the plasma sulphonitriding treatment is applied on a metal comprising a steel equivalent to a high speed tool steel or a steel equivalent to a stainless steel as the base material so as to form a nitrogen-containing compound layer on the surface and a sulfur-containing surface layer portion. The present invention is to provide a vane applied with the above-mentioned treatment.

It is preferable that the base material comprises the steel equivalent to a high speed tool steel of the below-mentioned component.

Component:C: 1.0 to 2.0 wt %, Si: 0.1 to 0.4 wt %,
Mn: 0.2 to 0.5 wt %, Cr: 3.0 to 5.0 wt %,
W: 11.0 to 14.0 wt %, Mo: 0.5 to 2.5 wt %,
V: 3.0 to 5.0 wt %, Fe: remainder.

It is preferable that the base material comprises the steel equivalent to a high speed tool steel of the below-mentioned component.

Component:C: 2.0 to 2.5 wt %, Si: 0.2 to 0.4 wt %,
Mn: 0.2 to 0.4 wt %, Cr: 2 to 6 wt %,
W: 10 to 12 wt %, Mo: 2.0 to 3.0 wt %
V: 5.0 to 8.0 wt %, Co: 6.0 to 9.0 wt %,
Fe: remainder.

It is preferable that the base material comprises the steel equivalent to a high speed tool steel of the below-mentioned component.

Component:C: 3.3 to 3.6 wt %, Si: 0.2 to 0.4 wt %,
Mn: 0.2 to 0.4 wt %, Cr: 3.0 to 3.5 wt %,
W: 12 to 14 wt %, Mo: 7.0 to 9.0 wt %,
V: 9.0 to 10.5 wt %, Co: 9.0 to 11 wt %,
TiN particles: 13.0 wt % or less, Fe: remainder.

It is preferable that the base material comprises the steel equivalent to a stainless steel of the below-mentioned component.

Component:C: 0.95 to 1.20 wt %, Si: 1.0 wt % or less,
Mn: 0.6 wt % or less, Ni: 0.6 wt % or less,
Cr: 16 to 18 wt %, Mo: 0.75 wt % or less,
Fe: remainder.

It is also preferable that the base material is applied with the hot isotastatic press (HIP) molding.

It is also preferable that the vane is a hollow vane obtained by the injection molding of the steel equivalent to a high speed tool steel.

It is further preferable that the steel equivalent to a stainless steel is sintered (liquid-phase sintering or vapor-phase sintering).

Further, the present invention is to provide a refrigerant compressor comprising an electric element having a rotary shaft and a compressing element driven by the rotary shaft of the electric element, for compressing and discharging a sucked HFC type refrigerant or refrigerant mainly comprising the HFC type refrigerant by the compressing element, wherein the compressing element comprises a cylinder, a roller rotating in the cylinder driven by an eccentric portion of the rotary shaft, a vane for separating the inside of the cylinder, contacting with the roller, an upper bearing portion and a lower bearing portion for sealing the openings of the cylinder, with the sliding surfaces of the roller and the vane, which are sliding members, are lubricated by a refrigerator oil, and the vane is made from a steel equivalent to a high speed tool steel or a steel equivalent to a stainless steel applied with the plasma sulphonitriding treatment on the surface.

It is preferable that the refrigerator oil is selected from the group consisting of an ester type lubricating oil, an ether type lubricating oil, and a mixture thereof.

Further, the present invention is to provide a method for treating a metal surface where the plasma sulphonitriding treatment is applied on the surface of the shaft made of a metal containing a ductile cast iron as the base material. Further, the present invention is to provide a rotary shaft where the plasma sulphonitriding treatment is applied on the surface of a metal containing a ductile cast iron as the base material.

It is preferable that the rotary shaft is a hollow ductile cast iron rotary shaft where the center hole is formed using the sublimation pattern type or the shell core.

Further, the present invention is to provide a refrigerant compressor comprising a compressing element and a rotary shaft for driving a compressing element, for compressing and discharging a sucked HFC type refrigerant or refrigerant mainly comprising the HFC type refrigerant by the compressing element, with the sliding surface of the rotary shaft lubricated by a refrigerator oil, and the plasma sulphonitriding treatment applied on the surface of the shaft made of a metal containing a ductile cast iron as the base material of the rotary shaft.

According to the above-mentioned configurations, a refrigerant compressor comprising a rotary shaft or a vane having a low friction coefficient in a sliding portion on the surface of the rotary shaft or the vane and a high wear resistance can be provided even in the case an ester type refrigerator oil or an ether type refrigerator oil is used as the refrigerator oil and an HFC type refrigerant is used.

DETAILED DESCRIPTION OF THE PREFERRED EMBODIMENTS

Hereinafter the present invention will be described with reference to FIGS. 1 to 3.

Figure 1:
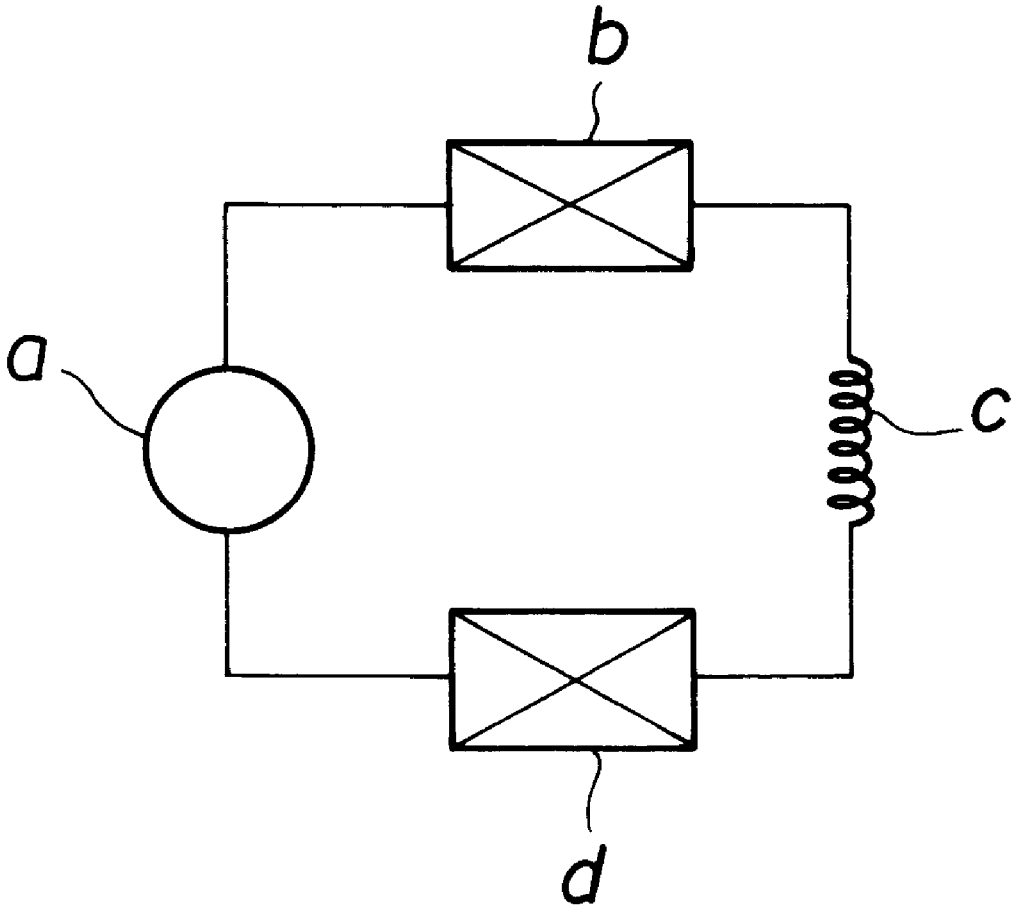
FIG. 1 is a refrigerating circuit diagram of a freezer.

FIG. 1 shows a refrigerating cycle of a freezer formed by connecting a refrigerant compressor a of the present invention for compressing and discharging an evaporated gaseous HFC type refrigerant to a condenser, a condenser b for condensing and liquefying the refrigerant, a capillary tube c for reducing the pressure of the refrigerant, and an evaporator d for evaporating the liquefied refrigerant, successively with a tube.

Figure 2:
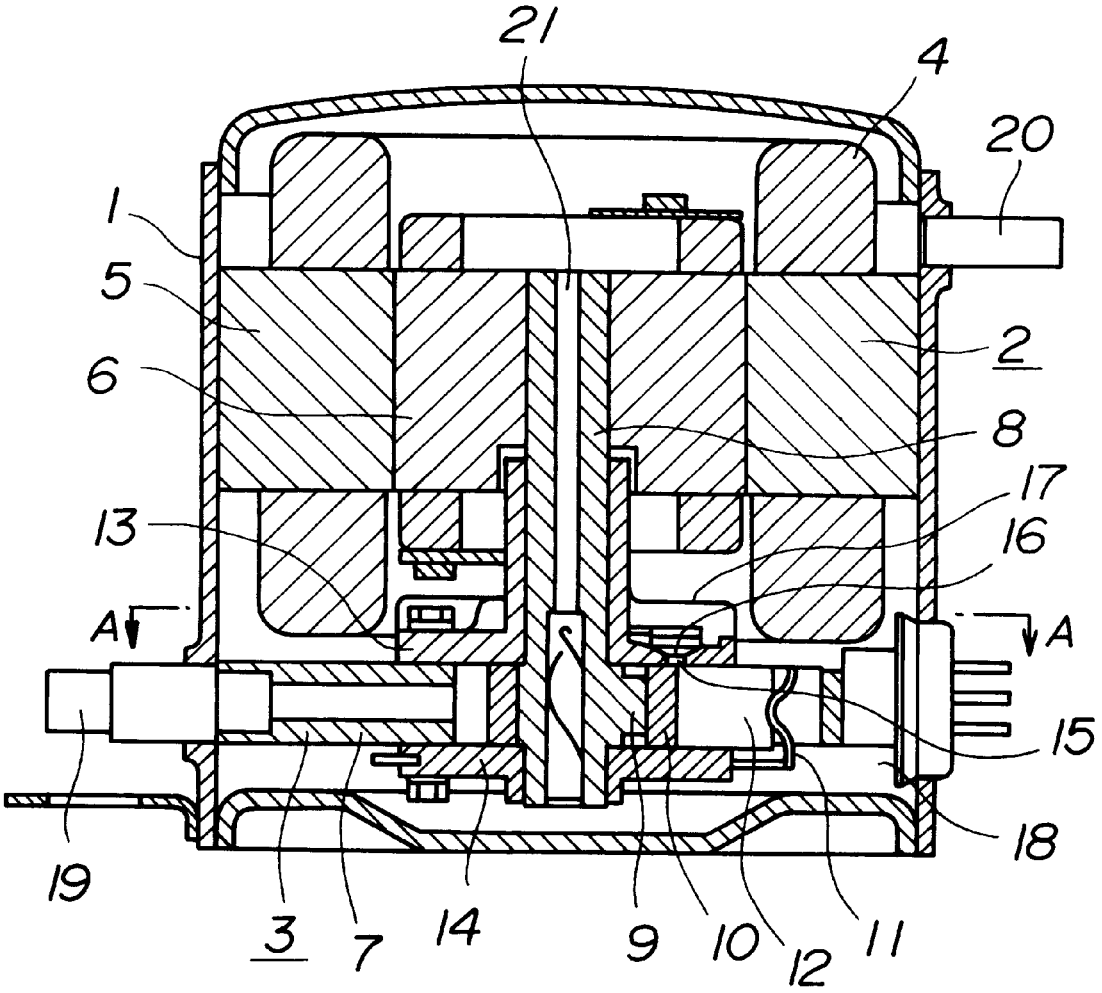
FIG. 2 is a vertical cross-sectional view of an embodiment of a refrigerant compressor of the present invention.
Figure 3:
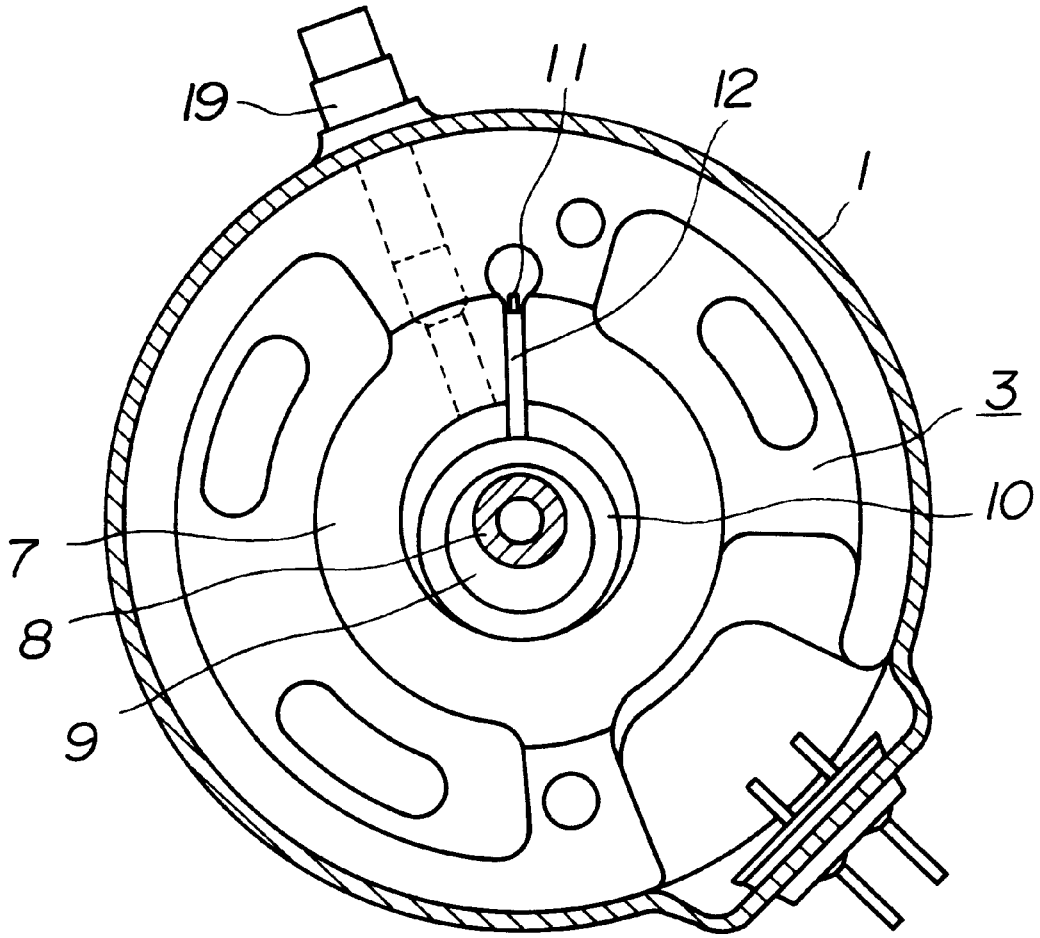
FIG. 3 is a horizontal cross-sectional view of the refrigerant compressor of FIG. 2.

In FIGS. 2 and 3, numeral 1 denotes a hermetically sealed container, having an electric element 2 on the upper side and a rotary compressing element 3 driven by the electric element on the lower side. The electric element 2 comprises a stator 5 having a coil 4 insulated with an organic material, and a rotor 6 provided inside the stator 5. The rotary compressing element 3 comprises a cylinder 7, a roller 10 rotating along the inner wall of the cylinder 7 in the cylinder driven by an eccentric portion 9 of a rotary shaft 8, a vane 12 pressed by a spring 11 contacting with the circumference of the roller 10 with pressure for separating the inside of the cylinder 7 into a suction side and a discharging side, an upper bearing 13 and a lower bearing 14 for sealing the openings of the cylinder 7 and supporting the rotary shaft 8.

The upper bearing 13 is provided with a discharging hole 15 communicating with the discharging side of the cylinder 7. Further, a discharging valve 16 for opening/closing the discharging hole 15 and a discharging muffler 17 covering the discharging valve 16 are attached on the upper bearing 13.

An HFC type refrigerant, such as a three component mixture refrigerant including R134a, R32 and R125 (hereinafter referred to as R407C) or a two component mixture refrigerant including R32 and R125 (hereinafter referred to as R410A) is sealed at the bottom of the hermetically sealed container 1. The refrigerant flows into the cylinder 7 of the rotary compressing element 3 and is compressed by the cooperation of the roller 10 and the vane 12.

An ester type refrigerator oil or an ether type refrigerator oil as a refrigerator oil 18 lubricates the sliding surfaces of the roller 10 and the vane 12, which are sliding members of the rotary compressing element 3, or the sliding surface of the rotary shaft 8.

Numeral 19 denotes a suction tube attached on the hermetically sealed container 1 for guiding the refrigerant to the suction side of the cylinder 7. Numeral 20 denotes a discharging tube attached on the upper wall of the hermetically sealed container 1, compressed by the rotary compressing element 3 to discharge the refrigerant outside the hermetically sealed container 1 via the electric element 2.

The refrigerant flown into the suction side of the cylinder 7 from the suction tube 19 is compressed by the cooperation of the roller 10 and the vane 12 so as to be discharged into the discharging muffler 17 through the discharging hole 15 by opening the discharging valve 16. The refrigerant in the discharging muffler 17 is discharged outside the hermetically sealed container 1 from the discharging tube 20 via the electric element 2.

The oil 18 accommodated at the bottom of the hermetically sealed container 1 is vacuumed through a hollow hole 21 of the rotary shaft 8 by the vacuum phenomenon caused by the swirling generated at the upper open end by the high speed rotation of the rotary shaft 8 so as to be supplied to the sliding surfaces between the sliding members such as the roller 10 and the vane 12 of the rotary compressing element 3, or the sliding surfaces between the rotary shaft 8 and the upper bearing 13 or the lower bearing 14 for lubrication. Further, it prevents leakage of the refrigerant compressed in the cylinder 7 into the lower pressure side.

The above-mentioned rotary shaft 8 is made from a highly elastic ductile cast iron (FCD), with the surface applied with the plasma sulphonitriding treatment. Therefore, the surface thereof has a low friction coefficient and a high wear resistance. Accordingly, even though a refrigerant is replaced by the HFC type refrigerant and a refrigerator oil is replaced by the ester type refrigerator oil or the ether type refrigerator oil, peel-off of the coating is not generated at the sliding surfaces between the rotary shaft 8 and the upper bearing 13 or the lower bearing 14. The vane 12 of the present invention is made from a steel equivalent to a high speed tool steel or a steel equivalent to a stainless steel, with the surface applied with the plasma sulphonitriding treatment. Therefore, the same effect can be achieved as the above-mentioned rotary shaft, and thus peel-off of the coating is not generated at the sliding surfaces between the vane 12 and the roller 10 even though a refrigerant is replaced by the HFC type refrigerant and a refrigerator oil is replaced by the ester type refrigerator oil or the ether type refrigerator oil.

It is considered that the friction coefficient becomes lower owing to a sulfur-containing surface layer portion of iron sulfide generated by the chemical reaction between iron and sulfur on the surface of the rotary shaft 8 or the vane 12 by the plasma sulphonitriding treatment. Further, it is considered that the surface with a high wear resistance can be obtained since the surface is covered with a compound layer generated by the chemical reaction of iron and nitrogen, such as FeN and $Fe_3N_4$. However, the reason is not limited thereto.

Conditions of the plasma sulphonitriding treatment of the present invention are not particularly limited. As a specific example of the treatment conditions, the rotary shaft 8 or the vane 12 is heated at 540 to 570° C. for 1 to 2 hours in a furnace, treated in an atmosphere of $N_2/H_2$=1:1 for about 2 hours, treated in an $N_2/H_2S$ mixed gas atmosphere at 540 to 570° C. for about 3 hours, and cooled for about 2 hours by furnace cooling. The internal pressure at the furnace cooling stage is about 3 torr owing to the introduction of a gas.

Furthermore, since the hole 21 is formed in the above-mentioned rotary shaft 8, using the sublimation pattern type or the shell core 21 in the casting stage, it is not necessary to make a hole by machining afterwards.

Since a steel equivalent to a high speed tool steel vane having a content of C, W, and V higher than that of SKH51 of the below-mentioned component is used as the steel equivalent to a high speed tool steel vane of the present invention, the wear resistance of the vane can be further improved.

Component: C: 1.0 to 2.0 wt %, Si: 0.1 to 0.4 wt %,
Mn: 0.2 to 0.5 wt %, Cr: 3.0 to 5.0 wt %,
W: 11.0 to 14.0 wt %, Mo: 0.5 to 2.5 wt %,
V: 3.0 to 5.0 wt %, Fe: remainder.

The production method of a vane used in the present invention is not particularly limited, but the below-mentioned method of the HIP molding, using a steel equivalent to a high speed tool steel containing the below-mentioned component (which includes a material corresponding to SKH57 and TiN particles (particle size of about 1 to 2 μm)) is preferable since a vane having an excellent wear resistance can be produced easily in terms of molding. The hot isostatic press molding (HIP molding) is a method where a powder or a preliminary molding body is sealed and deaerated in metal foil capable of forming a coated body at a high temperature, inserted in a container, heated and sintered while being pressed isotropically through an inert atmosphere medium, which can provide a homogeneous high density sintered body. In the present invention, a vane can be molded with the known HIP molding method by adding TiN particles in the material corresponding to SKH57 as mentioned above.

Component:C: 3.3 to 3.6 wt %, Si: 0.2 to 0.4 wt %,
Mn: 0.2 to 0.4 wt %, Cr: 3.0 to 3.5 wt %
W: 12 to 14 wt %, Mo: 7.0 to 9.0 wt %,
V: 9.0 to 10.5 wt %, Co: 9.0 to 11 wt %,
TiN particles: 13.0 wt % or less, Fe: remainder.

In the present invention, a hollow vane of a homogeneous high density and a high strength, having a hollow portion, obtained by injection molding and sintering a steel equivalent to a high speed tool steel can be used. It is preferable to use a steel equivalent to a high speed tool steel containing the below-mentioned component for the injection molding. Since the hollow vane is lightweight and significantly strong, a refrigerant compressor with an specification higher than a conventional product by about three times can be achieved by the use of the vane.

Component:C: 2.0 to 2.5 wt %, Si: 0.2 to 0.4 wt %,
Mn: 0.2 to 0.4 wt %, Cr: 2 to 6 wt %,
W: 10 to 12 wt %, Mo: 2.0 to 3.0 wt %,
V: 5.0 to 8.0 wt %, Co: 6.0 to 9.0 wt %,
Fe: remainder.

The component and the content are determined so as to allow mass production and to improve the wear resistance particularly of the vane.

On the other hand, the wear resistance of a vane can be improved by the use of an SUS440 type stainless steel vane having a high Cr content, containing the below-mentioned component as the vane made of the steel equivalent to a stainless steel in the present invention.

Component:C: 0.95 to 1.20 wt %, Si: 1.0 wt % or less,
Mn: 0.6 wt % or less, Ni: 0.6 wt % or less,
Cr: 16 to 18 wt %, Mo: 0.75 wt % or less,
Fe: remainder.

The component and the content are determined so as to allow mass production and to improve the wear resistance particularly of the vane.

It is preferable to use a vane made of a steel equivalent to a stainless steel obtained by sintering easily in the HIP molding or the injection molding.

Since the content of C in the vane relates to the hardness and the wear resistance after a heat treatment, it needs to be a certain value or within a certain range. In particular, with a value lower than the lower limit, the hardness after hardening and the wear resistance decline. Further, since Cr in the vane is a carbonate deposition element and thus contributes to the wear resistance, an optimum value or an optimum range needs to be selected therefor. W, Mo, V, Co, Si, Mo are also elements to contribute to reinforcing the base, and thus an optimum value or an optimum range needs to be selected therefor since an adverse effect may generate in the wear resistance outside the value or the range.

The type of a refrigerant compressor of the present invention may be a hermetically sealed type compressor as the above-mentioned or an open type compressor, and thus it is not particularly limited. The rotary shaft may be used as the rotary shaft for a rotary type compressor, a reciprocating type compressor, a vibrating type compressor, a multi-vane and rotary type compressor and a scroll type compressor.

EXAMPLE

Hereinafter the present invention will be explained concretely with reference to Examples and Comparative Examples, but it is not limited to Examples.

Example 1

The rotary shaft 8 where the center hole 21 was formed using a sublimation pattern type or the shell core in the casting stage was placed in a furnace, heated at 570° C. for 1 to 2 hours, and treated for 2 hours in an atmosphere where an $N_2/H_2$=1:1 gas was supplied. Then it was treated for 3 hours in an atmosphere where mixed gases of $N_2/H_2$=1:1 and $N_2/H_2S$=99:1 were supplied at 570° C. Then it was cooled down for 2 hours by furnace cooling (furnace internal pressure 3 torr) and thereby completing the plasma sulphonitriding treatment.

A bench stand test device where a rotary type compressor having the rotary shaft 8 applied with the plasma sulphonitriding treatment, a condenser, an expansion valve, and an evaporator were connected with tubes was used for the endurance test in the below-mentioned testing conditions so as to measure the wearing degree of the sliding portions of the rotary shaft of the rotary type compressor.

Pressure condition: high pressure 27 to 28 kg/cm$^2$·G low pressure 4.6 kg/cm$^2$·G Operation frequency: 100 Hz Operation time: 1000 hr, Refrigerant: R407C produced by Dupont Corp. (a mixed refrigerant of R134a, R32 and R125 with the ratio of 52:23:25)

Case upper part temperature: 95 to 100° C.

Materials of the sliding portions are as mentioned below.

Vane: high speed tool steel (high speed steel)

Roller: cast iron

Composition (wt %): T.C (total carbon): 3.0 to 3.7
Si: 1.5 to 2.5, Mn: 0.5 to 1.0
P: 0.2 to 0.3, S: 0.15 or less
Ni: 0.15 to 0.4, Cr: 0.5 to 1.2
Mo: 0.15 to 0.4, Fe: remainder.

Lubricating oil composition (oil): One prepared by adding 0.1 to 2.0% by weight of tricresylphosphate (TCP) and 0.01 to 10% by weight of an additive of an epoxy compound (EP) is added to a base oil, which is a polyol ester type oil (Fureol α68S produced by Japan Energy Corp.). 0.05 to 0.5% by weight of 2,6-di-t-butyl-paracresol is further added to the base oil (hereinafter referred to as OIL-1).

Results of the test showed the wearing degree of the rotary shaft 8 was 1. The number shows the five stage rating where 5 denotes bad, 3 tolerable range, and 1 excellent.

Comparative Example 1

In the process the same as Example 1 except that the rotary shaft 8 was applied with the ion nitriding treatment instead of the plasma sulphonitriding treatment, the test was conducted. Results of the test showed that the wearing degree of the rotary shaft 8 was 4.

Example 2

The vane made of the steel equivalent to a high speed tool steel containing the below-mentioned component was placed in a furnace, heated at 570° C. for 1 to 2 hours, and treated for 2 hours in an atmosphere where an $N_2/H_2$=1:1 gas was supplied. Then it was treated for 3 hours in an atmosphere where mixed gases of $N_2/H_2$=1:1 and $N_2/H_2S$=99:1 were supplied at 570° C. Then it was cooled down for 2 hours by furnace cooling (furnace internal pressure 3 torr) and thereby completing the plasma sulphonitriding treatment.

Component:C: 1.0 to 2.0 wt %, Si: 0.1 to 0.4 wt %,
Mn: 0.2 to 0.5 wt %, Cr: 3.0 to 5.0 wt %,
W: 11.0 to 14.0 wt %, Mo: 0.5 to 1.5 wt %,
V: 3.0 to 5.0 wt %, Fe: remainder.

A bench stand test device where the rotary type compressor comprising the vane 12 applied with the plasma sulphonitriding treatment, a condenser, an expansion valve, and an evaporator were connected with tubes was used for the endurance test in the below-mentioned testing conditions so as to measure the wearing degree of the sliding portions of the vane 12.

Pressure condition: high pressure 27 to 28 kg/cm$^2$·G, low pressure 4.6 kg/cm$^2$·G Operation frequency: 100 Hz Operation time: 1000 hr, Refrigerant: R407C produced by Dupont Corp.

Case upper part temperature: 95 to 100° C.

Roller: cast iron

Composition (wt %): T.C (total carbon): 3.0 to 3.7

Si: 1.5 to 2.5, Mn: 0.5 to 1.0

P: 0.2 to 0.3, S: 0.15 or less

Ni: 0.15 to 0.4, Cr: 0.5 to 1.2

Mo: 0.15 to 0.4, Fe: remainder.

Lubricating oil composition (oil): the above-mentioned OIL-1

Results of the test showed the wearing degree of the vane 12 was 1. The number shows the five stage rating where 5 denotes bad, 3 tolerable range, and 1 excellent. Even in a long time operation of the rotary type compressor, it was able to operate stably without the rise of the acid value of the oil nor generation of a sludge in the sliding portions of the surface of the vane 12.

Example 3

The vane made of a steel equivalent to a stainless steel containing the below-mentioned component was placed in a furnace, heated at 570° C. for 1 to 2 hours, and treated for 2 hours in an atmosphere where 1.5 liters/minute of $N_2$ and 1.5 liters/minute of $H_2$ were supplied. Then it was treated for 3 hours in an atmosphere where mixed gases of $N_2/H_2$=1:1 and $N_2/H_2S$=99:1 were supplied at 570° C. Then it was cooled down for 2 hours by furnace cooling (furnace internal pressure 3 torr) and thereby completing the plasma sulphonitriding treatment.

Component:C: 0.95 to 1.20 wt %, Si: 1.0 wt % or less,

Mn: 0.6 wt % or less, Ni: 0.6 wt % or less,

Cr: 16 to 18 wt %, Mo: 0.75 wt % or less,

Fe: remainder.

A bench stand test device where the rotary type compressor comprising the vane 12 applied with the plasma sulphonitriding treatment, a condenser, an expansion valve, and an evaporator were connected with tubes was used for the endurance test in the below-mentioned testing conditions so as to measure the wearing degree of the sliding portions of the vane 12.

Pressure condition: high pressure 27 to 28 kg/cm$^2$·G, low pressure 4.6 kg/cm$^2$·G Operation frequency: 100 Hz Operation time: 1000 hr, Refrigerant: R407C produced by Dupont Corp.

Case upper part temperature: 95 to 100° C.

Roller: cast iron

Composition (wt %): T.C (total carbon): 3.0 to 3.7

Si: 1.5 to 2.5, Mn: 0.5 to 1.0

P: 0.2 to 0.3, S: 0.15 or less

Ni: 0.15 to 0.4, Cr: 0.5 to 1.2

Mo: 0.15 to 0.4, Fe: remainder.

Lubricating oil composition (oil): the above-mentioned OIL-1

Results of the test showed the wearing degree of the vane 12 was 1. Even in a long time operation of the rotary type compressor, it was able to operate stably without the rise of the acid value of the oil nor generation of a sludge in the sliding portions of the surface of the vane 12.

Comparative Example 2

In the process the same as Example 2 except the vane 12 was treated with the ion nitriding treatment instead of the plasma sulphonitriding treatment, the test was conducted. Results of the test showed that the wearing degree of the vane 12, which partially had peel-off of the coating, was 4.

Industrial Applicability

According to the above-mentioned configuration of the present invention, a rotary shaft having a low friction coefficient in the surface sliding portions and a high wear resistance can be provided even in the case an ester type refrigerator oil or an ether type refrigerator oil is used as the refrigerator oil and an HFC type refrigerant is used. A refrigerant compressor comprising the rotary shaft can operate stably for a long time. Furthermore, the center hole of the rotary shaft can be formed economically and easily.

In addition, according to the above-mentioned configuration of the present invention, a vane having a low friction coefficient in the surface sliding portions and a high wear resistance can be provided even in the case an ester type refrigerator oil or an ether type refrigerator oil is used as the refrigerator oil and an HFC type refrigerant is used. A refrigerant compressor comprising the vane can operate stably for a long time.

Therefore, a great potential can be provided in terms of industrial applicability by the present invention.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for treating a metal surface, comprising applying a plasma sulfonitriding treatment on a surface of a metal so as to form a nitrogen-containing compound layer and a sulfur-containing surface layer portion of the surface thereof, wherein the metal comprises as the base material, the steel equivalent to a high speed tool steel of the below-mentioned component:

Component:C: 1.0 to 2.0 wt %, Si: 0.1 to 0.4 wt %,

Mn: 0.2 to 0.5 wt %, Cr: 3.0 to 5.0 wt %,

W: 11.0 to 14.0 wt %, Mo: 0.5 to 2.5 wt %,

V: 3.0 to 5.0 wt %, Fe: remainder.

2. A method for treating a metal surface, comprising applying a plasma sulfonitriding treatment on a surface of a metal so as to form a nitrogen-containing compound layer and a sulfur-containing surface layer portion of the surface thereof, wherein the metal comprises as the base material, the steel equivalent to a high speed tool steel of the below-mentioned component:

Component:C: 3.3 to 3.6 wt %, Si: 0.2 to 0.4 wt %,

Mn: 0.2 to 0.4 wt %, Cr: 3.0 to 3.5 wt %,

W: 12 to 14 wt %, Mo: 7.0 to 9.0 wt %,

V: 9.0 to 10.5 wt %, Co: 9.0 to 11 wt %,

TiN particles: 13.0 wt % or less, Fe: remainder.

3. A vane prepared by applying a plasma sulfonitriding treatment on a vane comprising a base material, so as to form a nitrogen-containing compound layer and a sulfur-containing surface layer portion on the surface thereof, wherein the base material comprises the steel equivalent to a high speed tool steel of the below-mentioned component:

Component:C: 1.0 to 2.0 wt %, Si: 0.1 to 0.4 wt %,

Mn: 0.2 to 0.5 wt %, Cr: 3.0 to 5.0 wt %,

W: 11.0 to 14.0 wt %, Mo: 0.5 to 2.5 wt %,

V: 3.0 to 5.0 wt %, Fe: remainder.

4. A vane prepared by applying a plasma sulfonitriding treatment on a vane comprising a base material, so as to form a nitrogen-containing compound layer and a sulfur-containing surface layer portion on the surface thereof, wherein the base material comprises the steel equivalent to a high speed tool steel of the below-mentioned component:

Component:C: 3.3 to 3.6 wt %, Si: 0.2 to 0.4 wt %,

Mn: 0.2 to 0.4 wt %, Cr: 3.0 to 3.5 wt %,

W: 12 to 14 wt %, Mo: 7.0 to 9.0 wt %,

V: 9.0 to 10.5 wt %, Co: 9.0 to 11 wt %,

TiN particles: 13.0 wt % or less, Fe: remainder.

5. The vane according to claim 4, wherein the base material is molded by the hot isotastatic press (HIP) molding.

6. A refrigerant compressor comprising an electric element having a rotary shaft and a compressing element driven by the rotary shaft of the electric element, for compressing and discharging a sucked HFC type refrigerant or refrigerant mainly comprising the HFC type refrigerant by the compressing element, wherein the compressing element comprises a cylinder, a roller rotating in the cylinder driven by an eccentric portion of the rotary shaft, a vane for separating the inside of the cylinder, and contacting with the roller, an upper bearing portion and a lower bearing portion for sealing the openings of the cylinder, with the sliding surfaces of the roller and the vane, which are sliding members, are lubricated by a refrigerator oil, and the vane comprises a base material whose surface has been subjected to a plasma sulfonitriding treatment so as to form a nitrogen-containing compound layer and a sulfur-containing surface layer portion on said surface, wherein the base material comprises the steel equivalent to a high speed tool steel of the below-mentioned component:

Component:C: 1.0 to 2.0 wt %, Si: 0.1 to 0.4 wt %,

Mn: 0.2 to 0.5 wt %, Cr: 3.0 to 5.0 wt %,

W: 11.0 to 14.0 wt %, Mo: 0.5 to 2.5 wt %,

V: 3.0 to 5.0 wt %, Fe: remainder.

7. A refrigerant compressor comprising an electric element having a rotary shaft and a compressing element driven by the rotary shaft of the electric element, for compressing and discharging a sucked HFC type refrigerant or refrigerant mainly comprising the HFC type refrigerant by the compressing element, wherein the compressing element comprises a cylinder, a roller rotating in the cylinder driven by an eccentric portion of the rotary shaft, a vane for separating the inside of the cylinder, and contacting with the roller, an upper bearing portion and a lower bearing portion for sealing the openings of the cylinder, with the sliding surfaces of the roller and the vane, which are sliding members, are lubricated by a refrigerator oil, and the vane comprises a base material whose surface has been subjected to a plasma sulfonitriding treatment so as to form a nitrogen-containing compound layer and a sulfur-containing surface layer portion on said surface, wherein the base material comprises the steel equivalent to a high speed tool steel of the below-mentioned component:

Component:C: 3.3 to 3.6 wt %, Si: 0.2 to 0.4 wt %,

Mn: 0.2 to 0.4 wt %, Cr: 3.0 to 3.5 wt %,

W: 12 to 14 wt %, Mo: 7.0 to 9.0 wt %,

V: 9.0 to 10.5 wt %, Co: 9.0 to 11 wt %,

TiN particles: 13.0 wt % or less, Fe: remainder.

8. The refrigerant compressor according to claim 7, wherein the base material is molded by the hot isotastatic press (HIP) molding.

* * * * *